US007748339B2

(12) United States Patent
Oh

(10) Patent No.: US 7,748,339 B2
(45) Date of Patent: Jul. 6, 2010

(54) RIGID INFLATABLE BOAT

(76) Inventor: Seung-hun Oh, 891-3, Jisan-ri, Samhyang-myeon, Muan-gun, Jeollanam-do 534-822 (KR)

( * ) Notice: Subject to any disclaimer, the term of this patent is extended or adjusted under 35 U.S.C. 154(b) by 0 days.

(21) Appl. No.: 12/347,099

(22) Filed: Dec. 31, 2008

(65) Prior Publication Data

US 2009/0205555 A1 Aug. 20, 2009

Related U.S. Application Data

(63) Continuation of application No. PCT/KR2007/000520, filed on Jan. 30, 2007.

(30) Foreign Application Priority Data

Jul. 5, 2006 (KR) ..... 10-2006-0063124

(51) Int. Cl.
*B63B 7/00* (2006.01)
*B63B 17/00* (2006.01)

(52) U.S. Cl. ..... 114/345; 114/364

(58) Field of Classification Search ..... 114/345, 114/355, 364, 271, 283–287; 441/35, 40, 441/41, 44, 45
See application file for complete search history.

(56) References Cited

U.S. PATENT DOCUMENTS 4,724,792 A * 2/1988 Cochran ..... 114/345
6,666,124 B2 * 12/2003 Fleming ..... 89/36.12

* cited by examiner

*Primary Examiner*—Daniel V Venne
(74) *Attorney, Agent, or Firm*—NSIP Law

(57) ABSTRACT

A rigid inflatable boat has a structure to position and protect an inflatable tube without having to separate the tube from a boat body. The rigid inflatable boat may include a rubber tube that is attached to each side of a boat body. A folding panel includes one hinged end on each lower side of the boat body and another end including a hook for coupling with a fastener formed on a top portion of the boat body. The rubber tube is connected to an inner surface of the folding panel and a side portion of the boat body by a connection mechanism. The connection mechanism is configured to connect the tube to an inner surface of the folding panel and to the side of the boat body including a pair of guide plates and a pair of insertion bars. The guide plates have one side attached to the inner surface of the moveable plate and the boat body and another side formed with guide grooves disposed longitudinally along the length of boat body. The insertion bars are wrapped with protective fabric and attached to an outer surface of the tube and configured to be inserted longitudinally into the guide grooves.

10 Claims, 5 Drawing Sheets

RIGID INFLATABLE BOAT

CROSS-REFERENCE TO RELATED APPLICATIONS

This is a continuation application of co-pending international patent application PCT/KR2007/000520 filed on Jan. 30, 2007 which claims priority of the Korean patent application KR 10-2006-0063124 filed on Jul. 5, 2006 both of which are incorporated by reference herein in their entirety for all purposes.

BACKGROUND

The following relates to a rigid inflatable boat, and more particularly, to a rigid inflatable boat including a rotary plate for protecting a rubber tube and easily storing the rubber tube without separating the rubber tube form the rigid inflatable boat when not in use by rotating upward the rotary plate after the rubber tube is flatten in order to keep the rubber tube between a boat body and the rotary plate, thereby protecting the rubber tube from ultraviolet light and avoiding inconvenience of unnecessary attaching and detaching of the rubber tube.

Generally, rigid inflatable boats are used for leisure or lifesaving. A conventional rigid inflatable boat includes a boat body formed of fiber reinforce plastic (FRP) to provide a room for a passenger, and rubber tubes attached to sides of the boat body and inflated with air for increasing a buoyant force acting on the rigid inflatable boat.

Generally, the rubber tubes are bonded to the boat body or detachably coupled to the boat body. The rigid inflatable boat has advantages of an FRP boat and advantages of a rubber boat.

When the rubber tubes are bonded to the boat body using an adhesive, the rubber tubes can be separated from the boat body due to incorrect bonding, defective adhesive, or aging with time. Furthermore, since the rubber tubes cannot be detached from the boat body, it is difficult to store the rigid inflatable boat when not in use. Furthermore, since the rubber tubes are directly exposed to ultraviolet light, the lifetime of the rubber tubes is decreased. In addition, since skills and specialties are required to repair the rigid inflatable boat, it is more difficult and expensive to repair and maintain the rigid inflatable boat.

On the other hand, when the rubber tubes are detachably attached to the boat body, it takes time and effort for a user to attach or detach the rubber tubes to or from the boat body. Furthermore, the rubber tubes can be damaged when the rubber tubes are attached to or detached from the boat body, thereby causing an unnecessary increase in the cost and maintenance of the boat. In addition, when the rubber tubes are detached from the boat body and are not used for a long time, the rubber tubes can be deformed or damaged by, for example, an insect or mouse. As a result, an accident can occur when the rigid inflatable boat is used with the deformed or damaged rubber tubes.

SUMMARY

In one general aspect, a rigid inflatable boat includes folding panel to protect an inflatable tube and allow easy storage of the tube without having to separate the tube from the rigid inflatable boat when not in use by upwardly rotating folding panel after the tube is deflated and flattened in order to keep the tube between the boat body and the folding panel. As a result, the inflatable tube may be stored for a long time without risk of losing or misplacing the rubber tube and avoiding inconvenience of unnecessary attaching and detaching of the rubber tube which may reduce the usable life of the tube.

In another general aspect, a rigid inflatable boat includes a boat body including two sides; an inflatable tube attached to each of the two sides of the boat body for increasing buoyancy of the rigid inflatable boat; a folding panel disposed on each of the two sides including a first end hinged on a lower portion of the side of the boat body configured to fold against the side of the boat body when the tube is deflated; and a connection mechanism configured to connect the tube to an inner surface of the folding panel and to the side of the boat body including a pair of guide plates and a pair of insertion bars, the guide plates having one side attached to the inner surface of the moveable plate and the boat body and another side formed with guide grooves disposed longitudinally along the length of boat body, the insertion bars being wrapped with protective fabric and attached to an outer surface of the tube and configured to be inserted longitudinally into the guide grooves.

Each of the folding panels may include a first member connected by a hinge to the boat body side; and a support member configured at an angle to the first member connected to the tube by the connection mechanism. The support member is coupled to the first member and configured to be positioned by sliding into the first member. The first member may include a slot and a hooking protrusion formed on an inner edge of the slot at a predetermined height, and the support member may include a coupling protrusion formed on an outer edge of the support member at a predetermined height for coupling with the hooking protrusion when the support member is inserted into the slot, the hooking protrusions configured to allow the support member to slide within and remain coupled to the first member without separation when inserted into the slot.

A mechanism may be disposed inside the tube in a direction configured to shrink the tube toward the first end of the folding panel when the tube is deflated and allow the folding panel to fold against the boat side.

An auxiliary folding panel may be hinged on each side of the boat body to cover a portion of the tube when inflated and to fold against the side when the tube is deflated.

The folding panels may conceal and protect the tubes when deflated for storage of the rigid inflatable boat. The folding panels also may increase the bottom surface area of the rigid inflatable boat and increase stability of the rigid inflatable boat in water when the tubes are inflated.

The folding panels may include another end configured to couple with a fastener on the boat body when the tube is deflated and the panel is folded against the side of the boat body.

The inflatable tube may be a rubber tube.

Other features will be apparent from the detailed description, drawings, and claims.

BRIEF DESCRIPTION OF THE DRAWINGS

Throughout the drawings and the detailed description, like reference numerals refer to the like elements.

DETAILED DESCRIPTION

Figure 1:
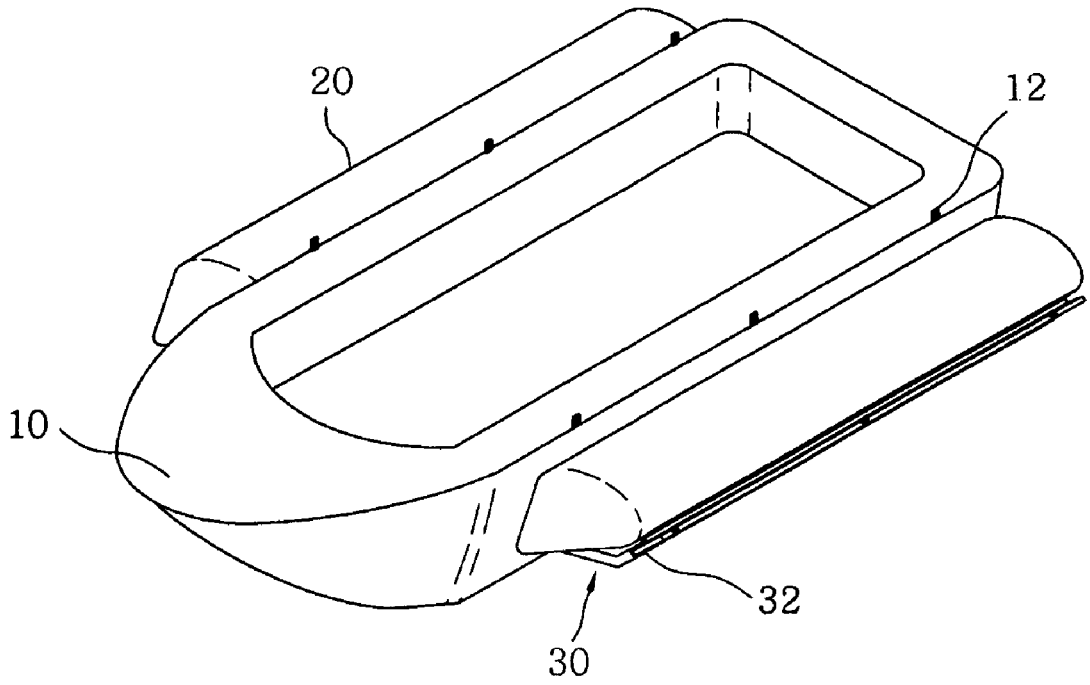
FIG. 1 is a perspective view illustrating an exemplary rigid inflatable boat.
Figure 2:
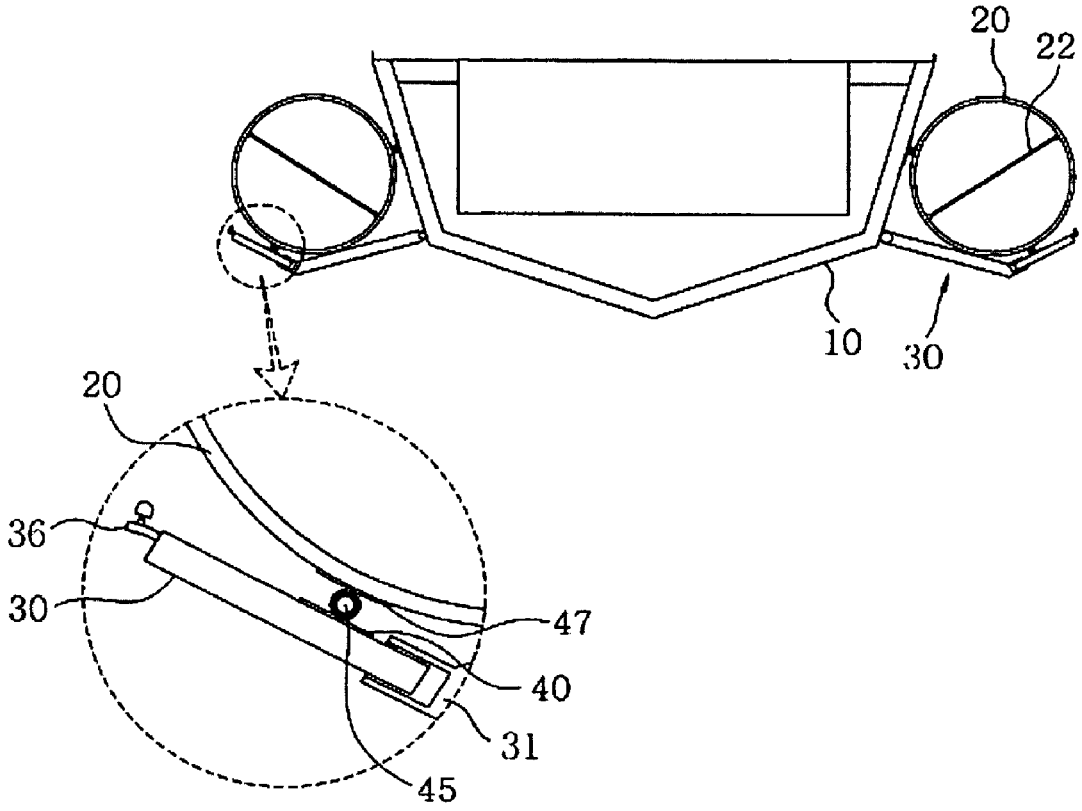
FIG. 2 is a cross-sectional view illustrating an exemplary the rigid inflatable boat.
Figure 3:
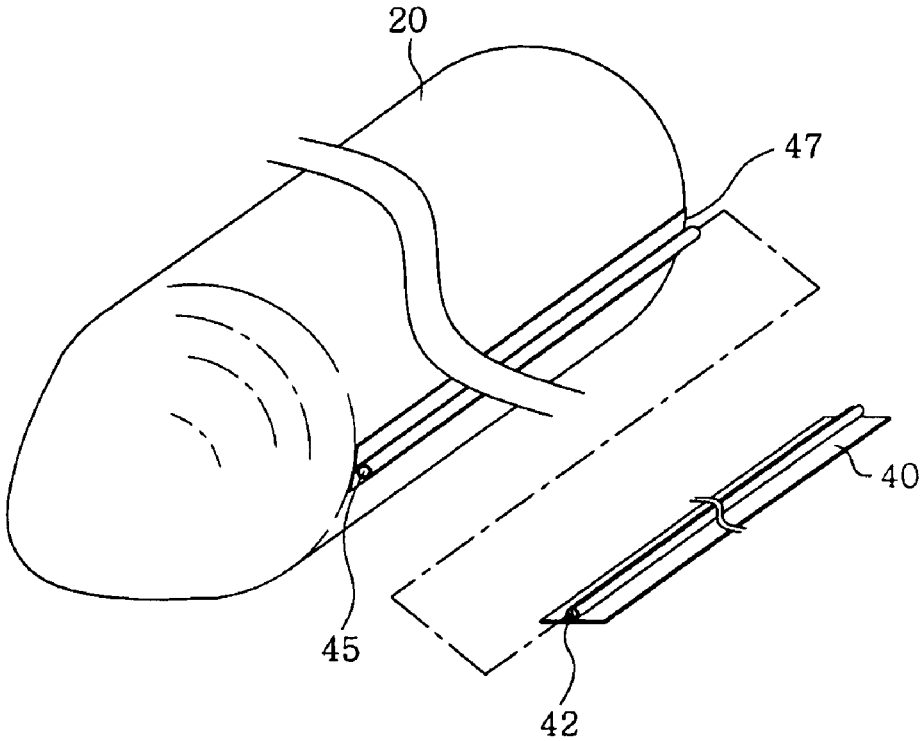
FIG. 3 is a view illustrating an example of the coupling of a rubber tube to a guide plate.
Figure 4:
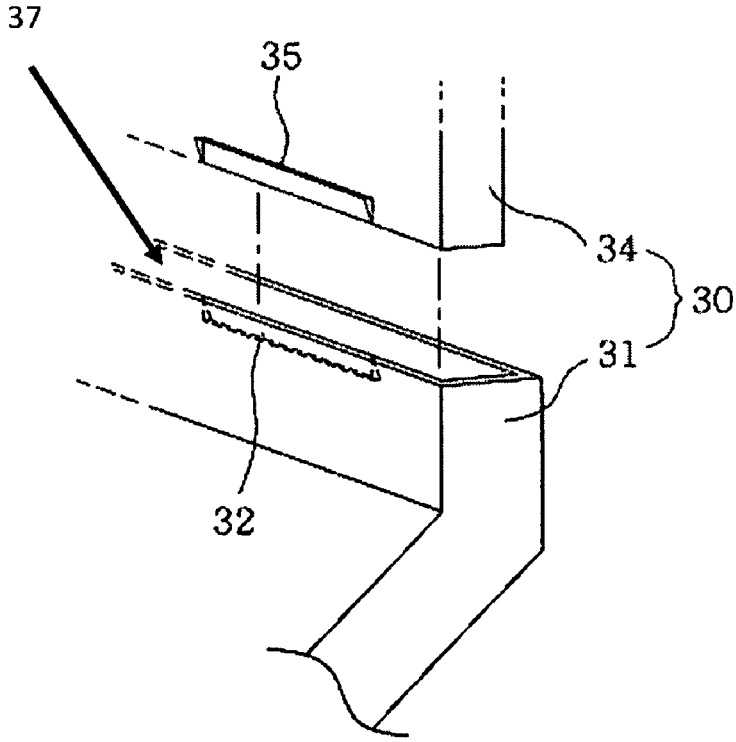
FIG. 4 is a view illustrating an example of insertion of a support member into a first member.
Figure 5:
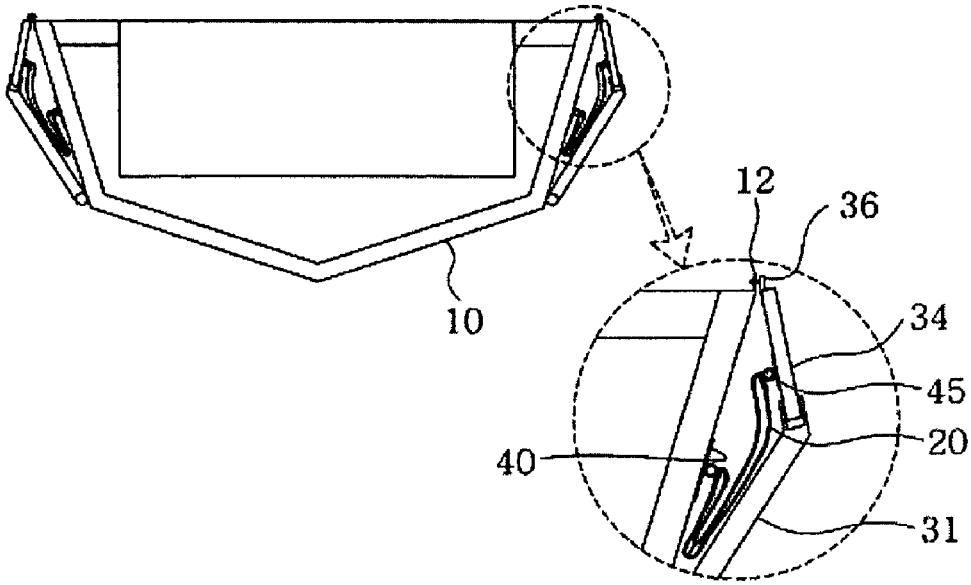
FIG. 5 is a view illustrating example of collapsing moveable plates to a boat body when rubber tubes are flattened.
Figure 6:
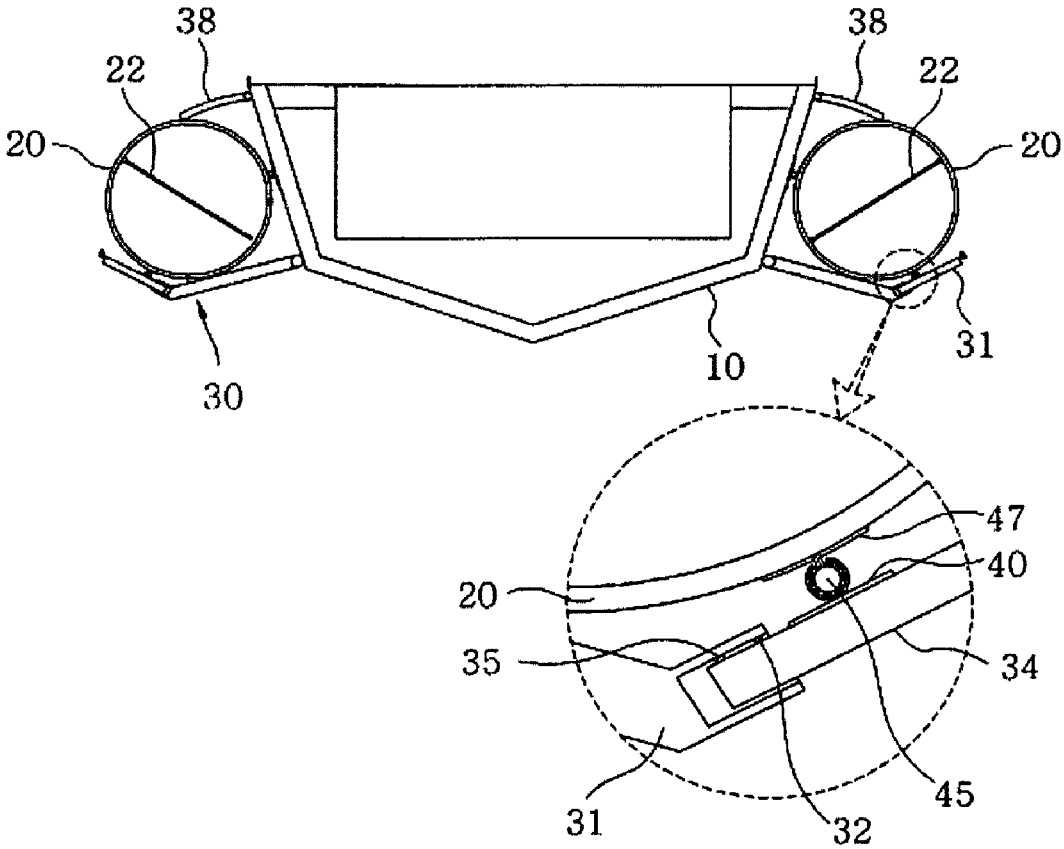
FIG. 6 is a cross-sectional view illustrating an exemplary rigid inflatable boat with auxiliary moveable plates.
Figure 7:
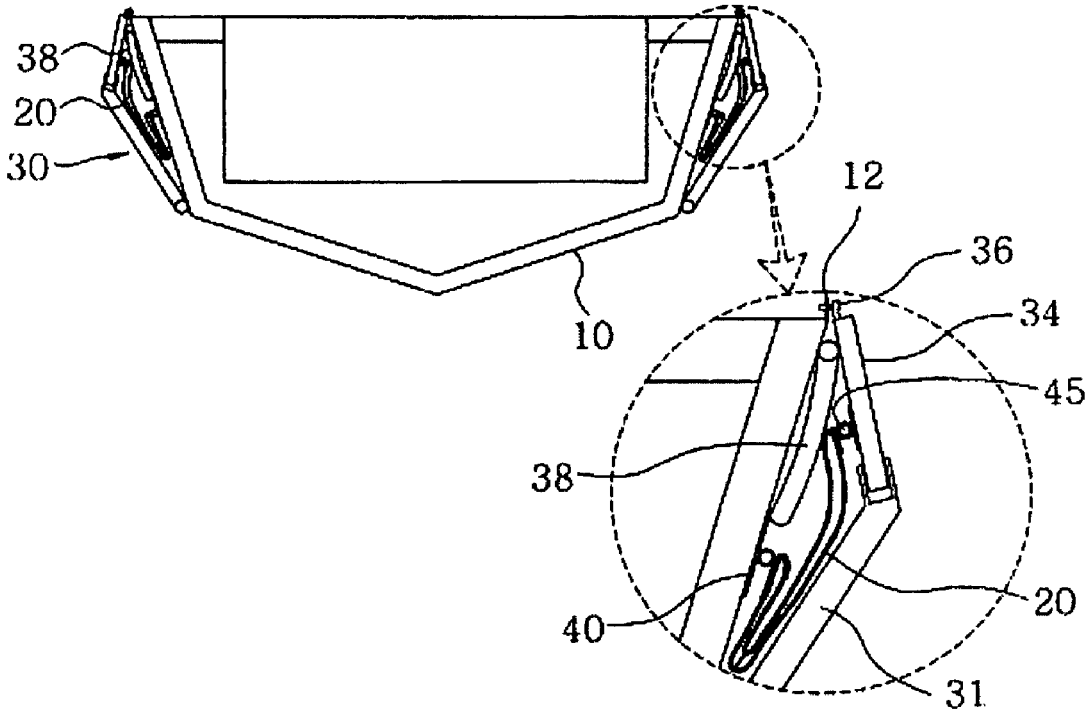
FIG. 7 is a view illustrating collapsing of the auxiliary rotary plates when the rubber tubes are flattened.

An exemplary rigid inflatable boat is described herein with reference to FIGS. 1-7. A shown in FIGS. 1-7, the rigid inflatable boat includes a boat body 10 with at least two sides. In one example, the boat body may be formed of fiber reinforced plastic (FRP). Inflatable tubes 20 are attached to both of the sides of the boat body 10 for increasing the buoyant force acting on the rigid inflatable boat. In one example, the inflatable tubes 20 are rubber; however, other flexible materials capable of being inflated by a gas may be used.

The rigid inflatable boat further includes folding panels 30 on each of the sides. One end of the folding panel 30 is hinged on a lower portion of the side of the boat body 10. Hooks 36 are formed on another side of the folding panels 30 for coupling with fasteners 12 formed on a top portion of the boat body 10.

Each of the rubber tubes 20 is disposed between the folding panel 30 and the boat body 10, and the folding panel 30 supports the rubber tube 20. Therefore, even when the rigid inflatable boat collides with a shore rock or submerged rock by accident, the rubber tube 20 is not torn or damaged since the folding panel 30 protects the rubber tube 20, thereby preventing an unexpected accident.

In one example, the folding panel 30 is bent outwardly from the boat side. For example, the folding panel may be bent or shaped like a conventional keel formed on a lower portion of a boat to minimize fluid resistance.

In one example, the hooks 36 and the fasteners 12 are provided to fix the folding panels 30 to the boat body 10 when the rubber tubes 20 are flattened or deflated. However, other mechanisms, such as a latch mechanism, may be used instead of the hooks 36 and the fasteners 12.

The rubber tube 20 can be disposed between the folding panel 30 and the boat body 10 using a connection mechanism fix and maintain the correct positioning of the rubber tube 20. In one example, the connection mechanism may include a pair of guide plates 40 attached to an inner side of the folding panel 30 and the side of the boat body 10, and a pair of insertion bars 45 attached to the outside of the rubber tube 20 for coupling with the guide plates 40. The guide plates 40 are formed with guide grooves 42 for receiving the insertion bars 45, and the insertion bars 45 are wrapped in protective fabrics 47.

Therefore, the rubber tube 20 may be easily fixed between the folding panel 30 and the boat body 10 by inserting the insertion bars 45 into the guide grooves 42 of the guide plates 40, and the rubber tube 20 can be easily stored in the fixed position without separation. That is, after deflating and flattening the rubber tube 20 by discharging air from the rubber tube 20, the folding panel 30 rotates towards and collapses against the side of the boat body 10 allowing the hooks 36 of the folding panel 30 to couple with the fasteners 12 of the boat body 10 so as to fix the folding panel 30. As a result, the rubber tube 20 is covered by the folding panel 30 and protected from damage and wear in the covered position.

The folding panel 30 includes a first panel member 31 hinged on the boat body 10 and a support panel member 34 connected to the rubber tube 20 by the connection mechanism. In one example, the support member 34 is slidably coupled with the first member 31. For example, when the rubber tube 20 is flattened by an external force depressing the tube 20, the support member 34 is inserted into the first member 31 up to a predetermined depth. When the depressing force is removed and the rubber tube 20 returns to its original shape, the support member 34 returns to its original position. As a result, damage and/or wear to the folding panel 30 (i.e., the first member 31 and the support member 34) is reduce or eliminated.

In one example, the first member 31 includes a slot 37 and a hooking protrusion 32 formed on an inner edge of the slot 37 at a predetermined height, and the support member 34 includes a coupling protrusion 35 formed on an outer edge of the support member 34 at a predetermined height for coupling with the hooking protrusion 32, such that the support member 34 can slide within and remain coupled to the first member 31 without separation when inserted into the slot 37.

An elastic band 22 is disposed in the rubber tube 20 in a diagonal direction, such that the rubber tube 20 may be easily shrunk toward a lower end of the folding panel 30 hinged on the boat body 10 when air is discharged from the rubber tube 20. Thus, when the folding panel 30 is rotated towards the side of the boat, the shrunken rubber tube 20 does not outwardly protrude. As a result, when the rigid inflatable boat is not in use, the rubber tube 20 is easily stored.

In one example, the elastic band 22 is used to shrink the rubber tube 20 to a desired shape. However, other elastic members, such as a spring may be used to shrink the rubber tube 20 to a desired shape.

In another example, the rigid inflatable boat further includes auxiliary folding panels 38 hinged on both upper sides of the boat body 10 to cover top portions of the rubber tubes 20.

Therefore, when a user fishes from the rigid inflatable boat, he/she can use the top surfaces of the auxiliary folding panels 38 to place something thereon. Furthermore, since the auxiliary folding panels 38 cover narrow gaps between the rubber tubes 20 and the boat body 10, the auxiliary folding panels 38 help prevent unexpected accidents, such as being caught in the gap between the rubber tubes 20 and the boat body 10.

The operation and effects of the rigid inflatable boat are described below. First, the guide plates 40 including the guide grooves 42 are attached to the sides of the boat body 10 and inner surfaces of the support members 34 of the folding panels 30. Then, the first members 31 of the folding panels 30 are hinged to the lower sides of the boat body 10.

Thereafter, the insertion bars 45 wrapped with the protective fabrics 47 are attached to opposing sides of rubber tubes 20 to correspond with the guide plates 40 attached to the boat body 10 and the folding panels 30. Then, the insertion bars 45 attached to the rubber tubes 20 are inserted into the guide grooves 42 of the guide plates 40 attached to the boat body 10 and the support members 34 of the folding panels 30. In this way, the rubber tubes 20 are stably fixed between the boat body 10 and the folding panels 30.

After that, the rigid inflatable boat can be used after inflating the rubber tubes 20. When the rigid inflatable boat is not in use, the rubber tubes 20 are flattened by discharging air from the rubber tubes 20, and the folding panels 30 are rotated upward toward and collapsed against the boat body 10 to couple the hooks 36 of the folding panels 30 to the fasteners 12 of the boat body 10 for fixing the folding panels 30 in place.

Once the rubber tubes 20 are disposed between the boat body 10 and the folding panels 30 when not in use, the rubber tubes 20 are protected and may be safely stored for extended periods of time. Furthermore, since the rubber tubes 20 are covered by the folding panels 30, the rubber tubes 20 are protected from unexpected damages. Therefore, life of the rubber tubes 20 is prolonged.

Meanwhile, when the rubber tubes 20 are inflated for use, the folding panels 30 also protect and support the lower portions of the rubber tubes 20. Therefore, when the rigid inflatable boat collides with a shore rock or submerged rock, the chance that the rubber tubes 20 are torn or damaged is reduced or eliminated because the rubber tubes 20 are protected by the folding panels 30. Furthermore, the rubber tubes 20 float on water with increased stability because of the folding panels 30. Thus, the rigid inflatable boat is more stable in waves.

Moreover, the folding panels 30 are bent in a predetermined shape to reduce fluid resistance so that the rigid inflatable boat moves on water more smoothly.

As described above, the rubber tubes are protected by the folding panels. Furthermore, the rubber tubes are safely stored between the boat body and the folding panels when not in use by rotating the folding panels upward against the sides of boat body and fixing the folding panels to the boat body after collapsing the rubber tubes. Therefore, when not in use, the rubber tubes are easily kept in a safe place without separating the rubber tubes from the rigid inflatable boat. Thus, the rubber tubes can be used for a long time since they are not easily lost.

In addition, since it is not necessary to attach or detach the rubber tubes to or from the rigid inflatable boat, convenience of use of the rigid inflatable boat is increased. Furthermore, the folding panels reduce fluid resistance and thus increase the speed of the rigid inflatable boat when the rigid inflatable boat moves on water. Moreover, since the folding panels expand the bottom surface area of the rigid inflatable boat, the rigid inflatable boat is less susceptible to being shaken by waves. Thus, the rigid inflatable boat can be used safely with increased stability.

Although a few examples have been shown and described, it will be understood that various modifications may be made. For example, suitable results may be achieved if the described techniques are performed in a different order and/or if elements are combined in a different manner and/or replaced or supplemented by other elements, components or their equivalents. Accordingly other implementations are within the scope of the following claims.

What is claimed is:

1. A rigid inflatable boat comprising:

a boat body including two sides;

an inflatable tube attached to each of the two sides of the boat body for increasing buoyancy of the rigid inflatable boat;

a folding panel disposed on each of the two sides including a first end hinged on a lower portion of the side of the boat body configured to fold against the side of the boat body when the tube is deflated; and a connection mechanism configured to connect the tube to an inner surface of the folding panel and to the side of the boat body including a pair of guide plates and a pair of insertion bars, one of the guide plates having one side attached to the inner surface of the folding panel, the other of the guide plates having one side attached to the boat body and another side of each guide plate formed with a respective guide groove disposed longitudinally along a length of the boat body, the insertion bars being wrapped with protective fabric and attached to an outer surface of the tube and configured to be inserted longitudinally into the guide grooves.

2. The rigid inflatable boat of claim 1, wherein each of the folding panels comprises:

a first member connected by a hinge to the boat body side; and a support member configured at an angle to the first member connected to the tube by the connection mechanism, wherein the support member is coupled to the first member and configured to be positioned by sliding into the first member.

3. The rigid inflatable boat of claim 1, further comprising a mechanism disposed inside the tube in a direction configured to shrink the tube toward the first end of the folding panel when the tube is deflated and allow the folding panel to fold against the boat side.

4. The rigid inflatable boat of claim 2, further comprising a mechanism disposed inside the tube in a direction configured to shrink the tube toward the first end of the folding panel when the tube is deflated and allow the folding panel to fold against the side of the boat body.

5. The rigid inflatable boat of claim 3, further comprising an auxiliary folding panel hinged on each side of the boat body to cover a portion of the tube when inflated and to fold against the side when the tube is deflated.

6. The rigid inflatable boat of claim 1, wherein the folding panels conceal and protect the tubes when deflated for storage of the rigid inflatable boat.

7. The rigid inflatable boat of claim 1, wherein the folding panels increase a bottom surface area of the rigid inflatable boat and increase stability of the rigid inflatable boat in water when the tubes are inflated.

8. The rigid inflatable boat of claim 1, wherein the folding panels include another end configured to couple with a fastener on the boat body when the tube is deflated and the folding panel is folded against the side of the boat body.

9. The rigid inflatable boat of claim 1, wherein each of the folding panels comprises:

a first member hinged to the boat body side; and a support member configured at an angle to the first member connected to the inflatable tube by the connection mechanism, wherein the first member includes a slot and a hooking protrusion formed on an inner edge of the slot at a predetermined height, and the support member includes a coupling protrusion formed on an outer edge of the support member at a predetermined height for coupling with the hooking protrusion when the support member is inserted into the slot, the hooking protrusions configured to allow the support member to slide within and remain coupled to the first member without separation when inserted into the slot.

10. The rigid inflatable boat of claim 1, wherein the inflatable tube is a rubber tube.

* * * * *